US008918941B2

(12) United States Patent
Lintern

(10) Patent No.: US 8,918,941 B2
(45) Date of Patent: Dec. 30, 2014

(54) FLOOR CLEANING MACHINE

(75) Inventor: David Lintern, Chard (GB)

(73) Assignee: Numatic International Limited, Camberley, Surrey (GB)

( * ) Notice: Subject to any disclaimer, the term of this patent is extended or adjusted under 35 U.S.C. 154(b) by 992 days.

(21) Appl. No.: 12/666,911

(22) PCT Filed: Jun. 27, 2008

(86) PCT No.: PCT/GB2008/002234

§ 371 (c)(1), (2), (4) Date: Apr. 2, 2010

(87) PCT Pub. No.: WO2009/004320

PCT Pub. Date: Jan. 8, 2009

(65) Prior Publication Data

US 2010/0180390 A1 Jul. 22, 2010

(30) Foreign Application Priority Data

Jun. 29, 2007 (GB) ..... 0712695.6
Apr. 11, 2008 (GB) ..... 0806668.0

(51) Int. Cl.

| | |
|---|---|
| ***A47L 11/16*** | (2006.01) |
| ***A47L 11/293*** | (2006.01) |
| ***A47L 11/164*** | (2006.01) |
| ***A47L 11/283*** | (2006.01) |
| ***A47L 11/30*** | (2006.01) |
| ***A47L 11/40*** | (2006.01) |

(52) U.S. Cl.

CPC ..... *A47L 11/164* (2013.01); *A47L 11/283* (2013.01); *A47L 11/305* (2013.01); *A47L 11/4038* (2013.01); *A47L 11/4061* (2013.01); *A47L 11/4077* (2013.01)

USPC ..... 15/49.1; 15/50.1

(58) Field of Classification Search

USPC ..... 15/49.1, 50.1

See application file for complete search history.

(56) References Cited

U.S. PATENT DOCUMENTS

| | | | | |
|---|---|---|---|---|
| 3,277,511 A * | 10/1966 | Little et al. | ..... | 15/320 |
| 3,345,671 A | 10/1967 | Wilson | ..... | 15/320 |
| 5,524,320 A | 6/1996 | Zachhuber | ..... | 15/320 |

FOREIGN PATENT DOCUMENTS

| | | |
|---|---|---|
| CA | 2691841 | 1/2009 |
| CN | 101720199 | 6/2010 |
| DE | 4200630 | 8/1992 |
| EP | 0087936 | 9/1983 |
| EP | 0551709 | 7/1993 |

(Continued)

OTHER PUBLICATIONS

International Search Report and Written Opinion mailed Oct. 29, 2008 by the International Searching Authority for PCT/GB2008/002234 filed Jun. 27, 2008 (Inventor—David Lintern // Applicant—Numatic International Limited) (12 pages).

(Continued)

*Primary Examiner* — Randall Chin

(74) *Attorney, Agent, or Firm* — Ballard Spahr, LLP

(57) ABSTRACT

A floor cleaning machine provided with three spaced-apart floor-facing rotationally drivable cleaning heads, each having a working axis of rotation generally perpendicular to the floor surface, the machine being provided with wheel means permitting translational movement of the machine along a cleaning path over a floor surface and an adjustable mounting means configured to permit selective adjustment of relative spatial locations of the cleaning heads so that a cleaning path swept by the heads may be selectively adjusted.

30 Claims, 8 Drawing Sheets

(56) References Cited

FOREIGN PATENT DOCUMENTS

| | | |
|---|---|---|
| EP | 0945551 | 9/1999 |
| EP | 2170147 | 4/2010 |
| FR | 2657769 | 8/1991 |
| GB | 0712695 | 8/2007 |
| GB | 0806668 | 5/2008 |
| JP | 06-154143 | 3/1994 |
| WO | WO 92/13480 | 8/1992 |
| WO | WO 2009/004320 | 1/2009 |

OTHER PUBLICATIONS

International Preliminary Report on Patentability and Written Opinion issued on Jan. 5, 2010 by the International Bureau for PCT/GB2008/002234 filed Jun. 27, 2008 (Inventor—David Lintern // Applicant—Numatic International Limited) (8 pages).

Preliminary Amendment filed by Applicant on Jan. 15, 2010 for EP Pat. Application. No. 08775789.4, which is a national phase of International Application No. PCT/GB2008/002234, filed Jun. 27, 2008 (Inventor—Lintern; Applicant—Numatic International Limited) (18 pages).

* cited by examiner

FLOOR CLEANING MACHINE

CROSS-REFERENCE TO RELATED APPLICATIONS

The present application is a National Phase Application of International Application No. PCT/GB2008/002234, filed Jun. 27, 2008, which claims priority to Great Britain Patent Application No. 0712695.6, filed Jun. 29, 2007 and Great Britain Patent Application No. 0806668.0, filed Apr. 11, 2008, and which applications are incorporated herein fully by this reference.

The present invention relates to the field of floor cleaning apparatus and in particular concerns a floor cleaning machine of a type that is provided with three spaced-apart floor-facing rotationally drivable cleaning heads each having a working axis of rotation generally perpendicular to the floor surface, the machine being provided with wheel means permitting translational movement of the machine along a cleaning path over the floor surface. In the context of this disclosure, the term "cleaning" is to be broadly interpreted to include scrubbing to remove dirt as well as polishing to improve surface appearance, or other floor treatments.

Machines of the type described in the foregoing have a cleaning path that is defined by the disposition and size of the one, or more, cleaning heads carried by the machine. The cleaning heads are disc-shaped or annular and have a diameter which defines the swept area of each head. The heads may be grouped in spaced apart pairs or threes, typically arranged so that the cleaning path of one head overlaps somewhat with its neighbour.

Typically the machines are capable of providing wet cleaning, in which a cleaning liquid (such as detergent solution) is distributed from a reservoir in the machine and onto the floor in advance of the cleaning heads. The dirt is dissolved or entrained into the liquid during the scrubbing process. A squeegee blade may be trailed behind the machine so as to collect dirty liquid and dry the floor. The squeegee arrangement typically includes a suction device for lifting collected liquid and conveying it to a collection reservoir for subsequent disposal.

Machines used for contract or commercial cleaning of large floor areas typically have a cleaning path width that is designed for the particular role. For example a machine intended to clean school corridors may have a narrow path dictated by door widths, whereas a machine for cleaning a sports arena may have a wider path. At present machines are provided in various sizes with correspondingly sized cleaning heads. It is an object of the present invention to provide a machine that has the versatility to be used in a wide range of cleaning tasks that would usually require two or more different machines.

DE-A-4200630 (Zachhuber) discloses a floor scrubber which includes a primary cleaning head disposed at a front end region of the machine. Two smaller ancillary cleaning heads are provided behind and on either side of the primary head. These are mounted on trailing arms which can pivot laterally outwards to increase the cleaning path width. Each of the ancillary heads has an associated s-plan squeegee extension which ensures that liquid is collected even when the cleaning path is extended beyond the width of a trailing squeegee blade. JP-A-6154143 (Johnson KK) discloses a similar arrangement of cleaning heads which permits the cleaning path to be expanded. In this device a single electric drive motor is used to drive all heads via a complex drive belt and pulley arrangement.

It is an object of the present invention to provide a cleaning machine having an adjustable cleaning path width, which may be configured to provide the selected cleaning width.

It is a further object to provide a cleaning machine which has a cleaning action which facilitates collection of liquid from a floor surface.

Other objects and benefits will be apparent from the description below.

Thus according to one aspect of the invention there is provided a floor cleaning machine provided with three spaced apart floor-facing rotationally drivable cleaning heads each having a working axis of rotation generally perpendicular to the floor surface, the machine being provided with wheel means permitting translational movement of the machine along a cleaning path over the floor surface, wherein the machine is provided with moveable mounting means configured to permit selective adjustment of relative spatial locations of the cleaning heads so that a cleaning path swept by the heads may be adjusted from a first arrangement in which the cleaning path swept has a first width to a second arrangement in which the cleaning path swept has a second width corresponding to the adjusted spatial location of the cleaning heads.

The moveable mounting means preferably comprises width selection means adapted to provide a plurality of selectable discrete cleaning path widths each corresponding to an adjusted relative spatial location of the cleaning heads. By plurality, the inventor means more than two. In a preferred arrangement there are three discrete cleaning path width settings. There could however be four or five or more.

In a preferred structure, one of the cleaning heads is centrally located and there are two laterally disposed cleaning heads on either side of the central head, wherein the lateral cleaning heads are suspended from moveable mounting means which permit the axis of rotation of each lateral head to be displaced laterally relative to the central head so as to widen the swept cleaning path.

The moveable mounting means in a preferred aspect of the invention comprises width selection means adapted to provide a plurality of selectable lateral displacement settings for the lateral cleaning heads, each setting corresponding to a predetermined cleaning path width, so that the width of the cleaning path may be selected at a chosen one of a plurality of discrete widths.

In one embodiment, the width selection means may comprise an arrangement in which each displacement setting is associated with the engagement of a detent feature with one of a plurality of spaced apart displacement constraint features. The width selection means may comprise a manually operable actuator which permits manual setting of the path by moving the detent feature to a selected displacement constraint feature.

The actuator may comprise a rocking lever arm, which arm has an end region which is provided with the detent feature. Another end region of the lever arm may be provided with handle means which may be manually grasped to rock the lever arm about its pivot and thereby move the detent feature.

The detent on the lever arm may be locked in position at each displacement constraint feature by engagement of the said another end of the lever arm with each of a plurality of arm constraint features.

In yet another aspect of the invention, the width selection means acts so as to limit outward lateral displacement of the lateral cleaning head, but does not act to prevent inward lateral movement of the lateral cleaning head.

The displacement constraint features may comprise laterally and vertically spaced apart outward facing facets formed on a travelling member which displaces laterally with an associated cleaning lateral head. Each facet may comprise a side face of one of a plurality of step features formed on a surface of the travelling member.

The detent feature may comprise a rod which may be located parallel to and against each facet to provide constraint. As the facets are side facing, they do not provide constraint against inward movement of the travelling member.

In a preferred embodiment the travelling member comprises a housing which accommodates and protects the associated lateral cleaning head against impacts when the cleaning head is laterally displaced in an expanded width cleaning path configuration.

An outside region of each lateral cleaning head is provided with a protective bumper which travels with the lateral head during lateral displacement thereof. The bumper may be attached to the machine at a forward pivot location and trails therefrom, the bumper thereby being configured to splay laterally about the pivot when the cleaning head is displaced laterally.

The lateral cleaning heads may be mounted on the machine via respective pivoted struts, and the pivot of each strut may be behind the forward pivot location. The strut may carry at an outer region thereof a wheel or roller which abuts an inner surface of the bumper. The bumper may comprise a housing which accommodates an outer region of the cleaning head. A trailing end region of the bumper may be slidably retained in a C-section laterally extending channel.

In yet another aspect of the invention there is provided a floor cleaning machine as hereinbefore described wherein the machine has a preferred direction of cleaning travel which defines a forward end of the machine and a centrally located cleaning head is located aft on the machine relative to two other laterally disposed cleaning heads which are located forward and either side of the central head.

In this configuration the collection of cleaning liquid solution or other liquid from a floor surface may be enhanced, because the outer two cleaning heads funnel liquid to the central head. The outer heads may spin in an inward direction of rotation to draw liquid back to the central rear cleaning head. This rear cleaning head may be followed by a vacuum squeegee blade assembly, towed by the machine. In this way liquid is collected, even if the outer cleaning heads operates outside of the width swept by the towed squeegee assembly.

In a preferred arrangement the cleaning heads are arranged at the apexes of an isosceles triangle. There may be a centrally located cleaning head and two lateral heads on either side thereof, the lateral heads being carried by respective swinging arms which permit splaying travel of each lateral head with respect to the central head.

The centrally located head may be suspended from a mounting bracket, the mounting bracket providing pivoting anchorages for the two swinging arms. The swinging arms preferably extend generally forward of each pivoting anchorage. The mounting bracket may comprise upper and lower mounting plate features, between which a pivot axle is held.

Each cleaning head may be provided with an associated electric drive motor. The motors associated with the lateral heads may be carried by, and travel with, a corresponding swinging arm.

Biasing means may be provided for biasing the swinging arms outwards, whilst clearance is provided which permits inward swinging of the arms in response to an arm encountering obstruction. The biasing means may be a tension spring operating between each arm and the machine chassis.

Two lateral cleaning heads disposed on either side of a central cleaning head may each be shrouded by an associated housing portion which travels with the lateral cleaning head during outward movement thereof to expand the cleaning path. The housing portions are preferably restricted in their outward travel to a plurality of discrete width settings and the housings constrain outward travel of the lateral cleaning heads to an extent dictated by the width settings. Each lateral cleaning head may be carried by a swinging arm which may splay to expand the cleaning path, and each associated housing portion may be pivotally anchored at one end thereof.

Each swinging arm may be provided with a wheel or roller (or other low contact resistance means) which abuts an inner surface of the associated pivoted housing portion so that splaying of the swinging arms is limited in extent by the wheel or roller acting on the housing portion inner surface. Preferably, each housing portion is provided with, or configured as, a protective bumper located outside the rotation path of the lateral cleaning heads so as to protect the lateral heads against impact from external obstructions during use.

In accordance with the invention, a single machine may be selectively adjusted to have two, three, or more different cleaning path widths. The same machine can be configured to be narrow enough to pass through doorways, or configured as a broad path cleaner for wide expanse cleaning, such as gymnasium halls.

The adjustment may be achieved by several means such as, but not limited to, a mechanical engagement in various positions, a linear hydraulic actuator or actuators which may provide a smoothly variable adjustment, a rack and pinion arrangement and other means available to the person skilled in the art. As mentioned in the foregoing the preferred means are a detent and a plurality of constraint features. The detent feature may be a male feature such as a rod, a spigot, a cam or a pawl. However the detent feature may alternatively be female; such as a depression, a slot, a bore or a groove. Similarly, the constraint features may be male or female as set out above, provided that the detent feature is limited in moving in the desired region. In the preferred arrangement, the constraint feature is simply a planar facet against which the detent abuts.

In a preferred arrangement, the mounting means are adapted to provide three or more discrete cleaning head arrangements, so that there are three or more corresponding cleaning widths which may be selected. Biasing means, such as tension or compression springs, coils springs, or leaf springs may be provided for biasing the swinging arms of the lateral cleaning heads outwards, whilst clearance is provided which permits inward swinging of the arms in response to an arm encountering obstruction.

As the cleaning head may be provided with an associated electric drive motor, this facilitates the splaying apart of individual cleaning heads by avoiding the need for complicated drive belt paths or gearing to drive from a single motor. This also allows each cleaning head's power or speed to be tailored to the cleaning requirements and local floor surface.

Following is a detailed description, with reference to the drawings, of a machine according to the present invention which is presented by way of example only and to aid the skilled person in putting the invention into effect. It is not intended to limit the scope of protection, which is defined by the claims hereinafter.

IN THE DRAWINGS

Figure 1:
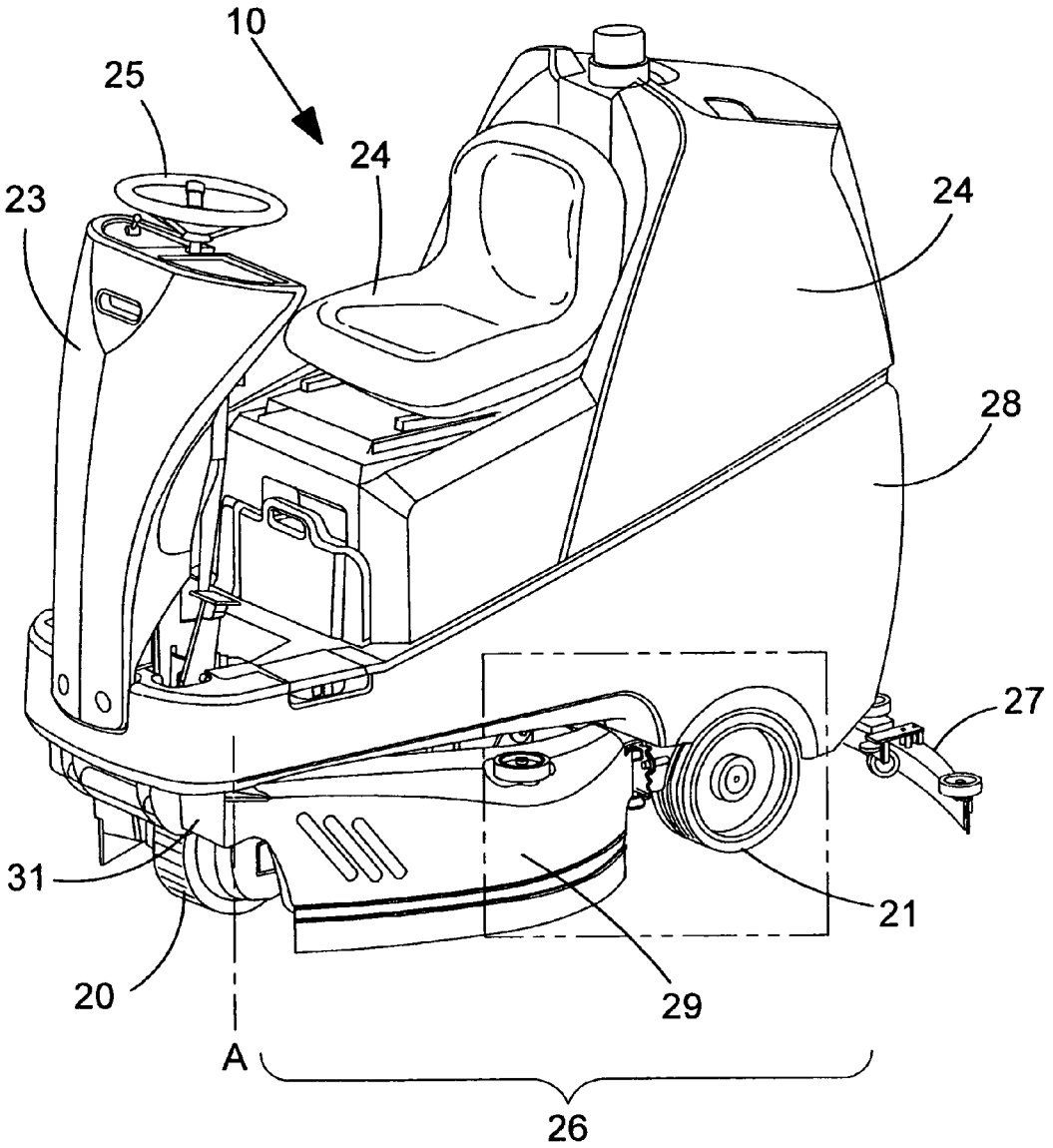
FIG. 1 is a perspective view of a floor cleaning machine according to the invention.
Figure 1A:
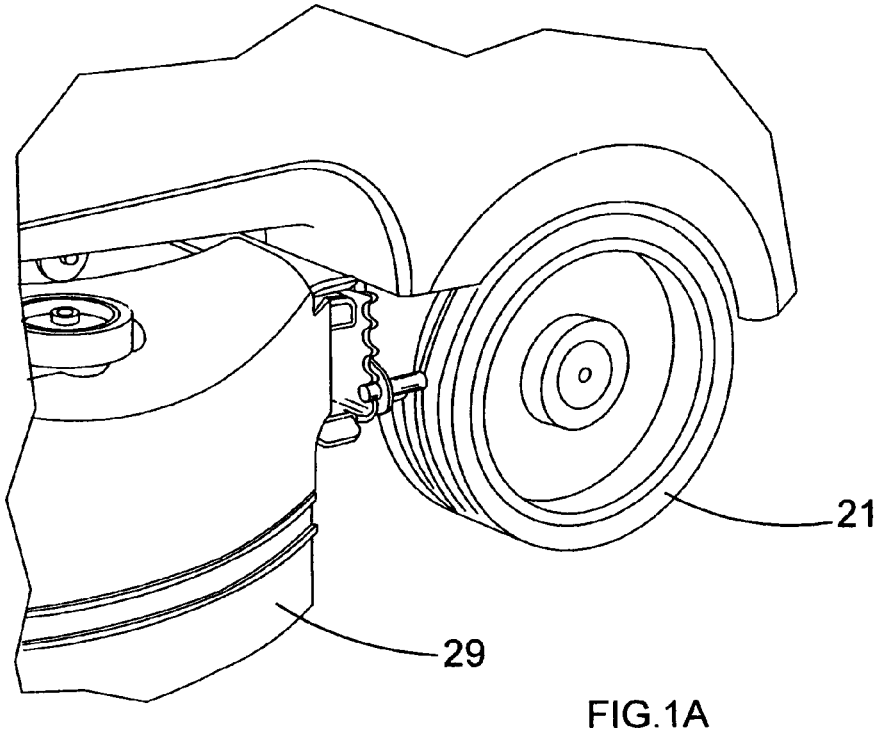
FIG. 1A is an enlarged view of a side pod region of the machine.

In FIG. 1 a ride-on floor cleaning machine is shown generally at 10. The machine has a three-wheeler configuration with a front drive wheel 20 and two rear wheels 21 (one only visible). An upper portion of the machine comprises a body housing 23 which is provided at a front end region with an operator's seat 24 and a steering wheel 25. A rear end region 28 of the body housing houses reservoirs (not visible) for cleaning liquid solution and collected dirt-laden fluid respectively. The machine has a lower chassis portion which includes a cleaning head arrangement 26 for cleaning a floor and a rear vacuum squeegee blade assembly 27 for collecting liquid from the floor surface.

Figure 1B:
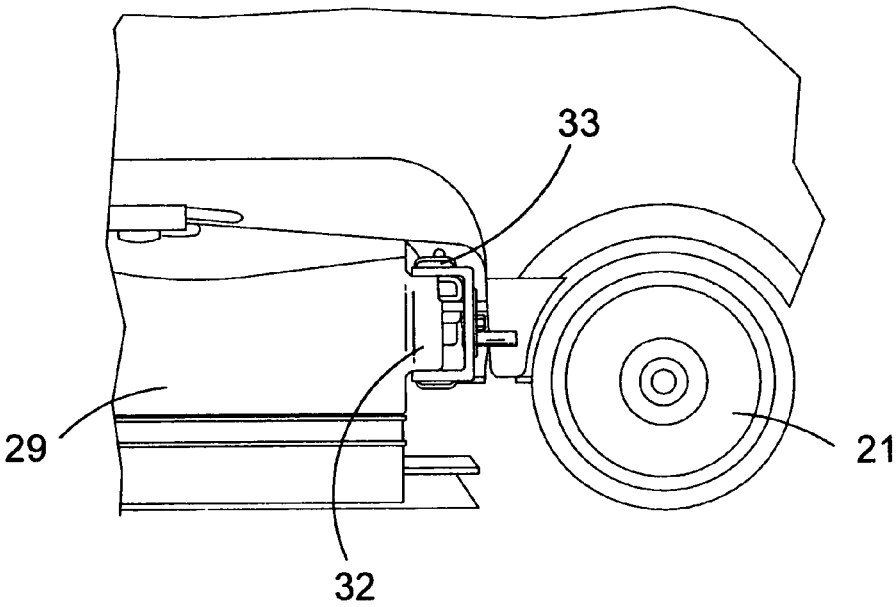
FIG. 1B is a side view of the same region.

A side pod 29 acts as a bumper and shrouds and houses an outer edge region of a disc-shaped lateral cleaning head (shown in FIG. 2). A front region 31 of the pod is pivotally mounted to the machine chassis via a boss (not shown). This permits the pod to pivot about a vertical axis A. A rear end region of the pod is formed as a generally rectilinear shoulder 32, shown in FIG. 1B. The shoulder is located in an open C-section channel 33. Thus the rear end of the pod can slide in the channel as the pod pivots about axis A.

The pod arrangement is mirrored on the other side of the machine. This is shown more clearly in FIGS. 2A to 2D.

In each of the views 2A, 2B and 2C there are three 300 mm diameter cleaning heads 34, and 36 each located at the apex of an isosceles triangle. Other head sizes are of course possible. The cleaning heads are conventional in design and comprise an engineering plastics material with an annular covering of bristles (not visible). In this embodiment a central cleaning head 35 is offset rearwardly in the machine, with the two outer heads 34, 36 forward and laterally spaced in relation to the rear head 35. The cleaning path swept by the machine corresponded to the lateral span of the two outer heads. Three configurations are shown, corresponding to swept paths of 650 mm, 750 mm and 850 mm.

Figure 2A:
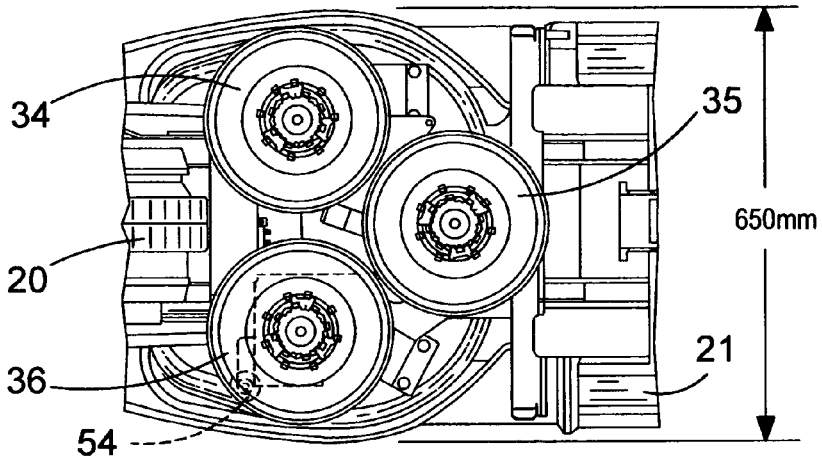
FIGS. 2A, 2B and 2C are underside views of the machine showing the configuration of cleaning heads.
Figure 2B:
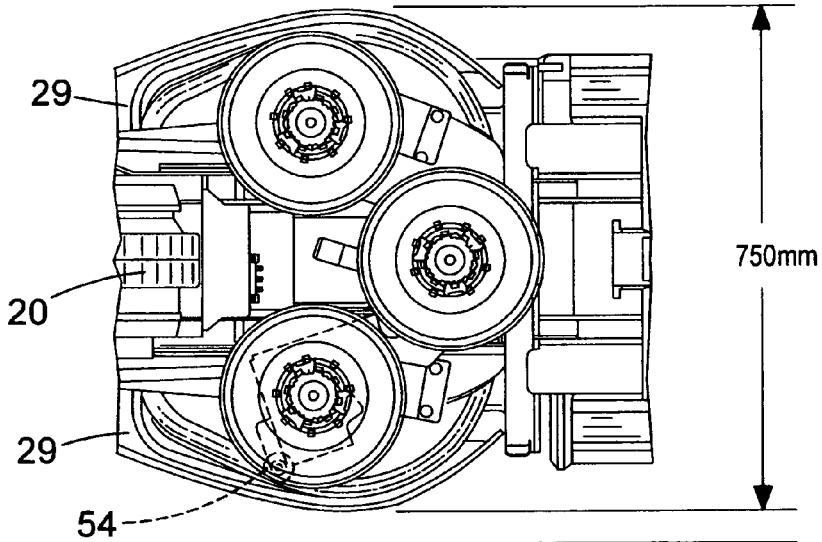
Figure 2C:
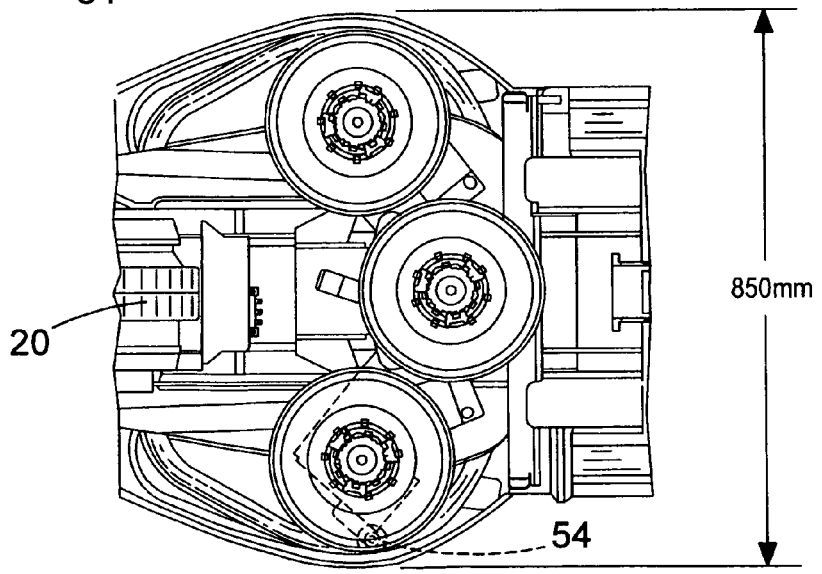
Figure 2D:
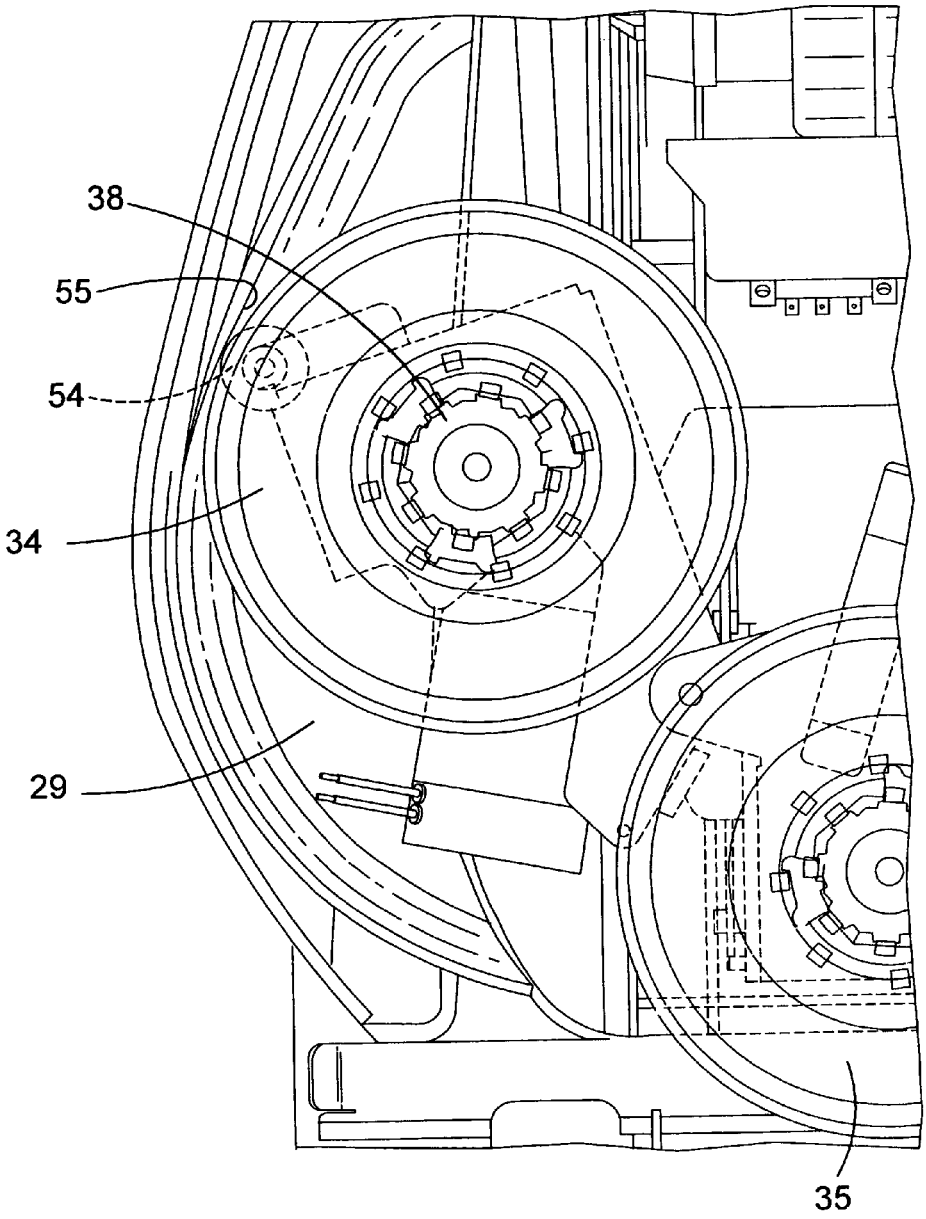
FIG. 2D is an enlarged view of a portion FIG. 2A.

FIG. 2D is an enlarged portion from FIG. 2A. This shows a cleaning head mounting chuck 38. The arrangement and mounting of cleaning heads is shown more clearly in FIG. 3.

Figure 3:
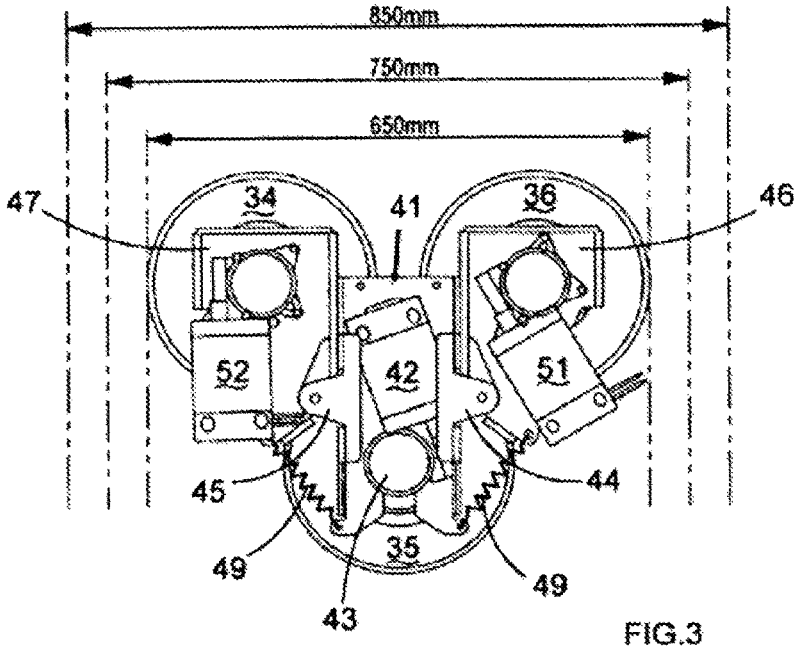
FIG. 3 is a plan view from above of a cleaning head mounting assembly for use in the machine.

FIG. 3 is a view from above of a cleaning head mounting assembly. A central steel plate 41 carries a first electric motor 42 and associated drive gear hub 43. The drive gear is connected to a cleaning head chuck 38 which is clamped against a lower central portion (not visible) of the central cleaning head 35. The plate 41 is provided at each side with mounting brackets 44, 45. The brackets have upper ear portions (visible) and corresponding lower ear portions, with vertical axle pins therebetween. The bracket is thus pivotally connected to outer plates 46, 47. These plates serve as respective swinging arms, biased outwardly by respective coil springs 49. The outer plates each carry an electric drive motor 51, 52 for the associated outer cleaning heads 34, 36. As the outer plates splay a cleaning path of swept by the heads will be increased.

Each of the swinging plates is provided at a distal corner region thereof with a roller wheel (54 in FIG. 2D), having a vertical axis of rotation. This wheel contacts an inner camming surface 55 of the pod 29. Thus the pods serve to limit outward splaying of the outer cleaning heads by rolling contact of the wheel. The wheel permits resistance free splaying and retraction of the outer cleaning heads.

Figure 5:
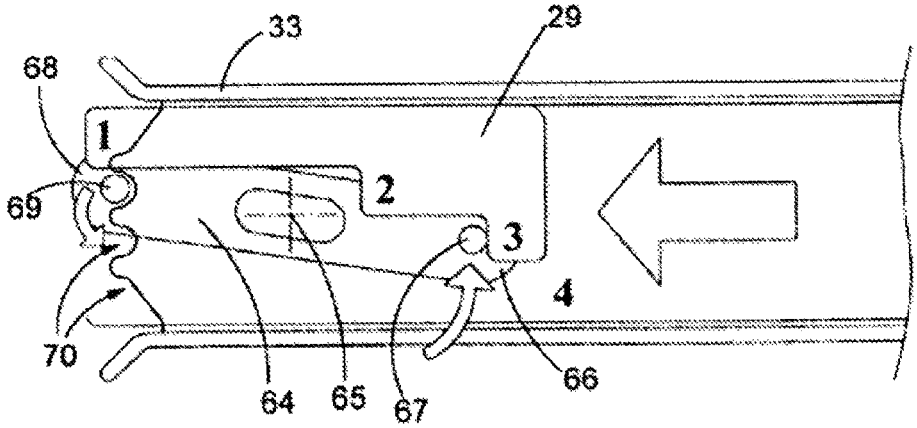
FIG. 5 is a partly sectional end view of the side pod in situ in the machine of the invention, showing details of a detent mechanism.
Figure 4B:
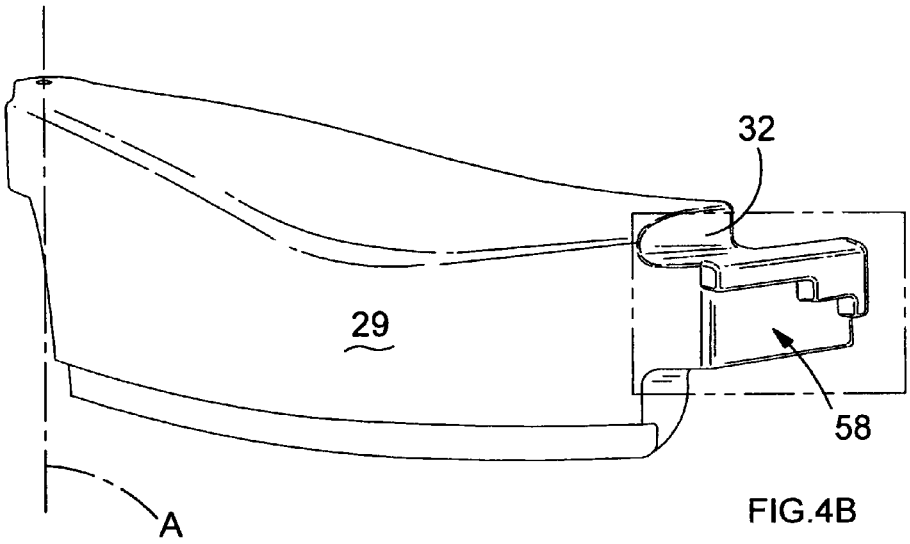
FIG. 4B is an enlarged view of an end region of the side pod.
Figure 6:
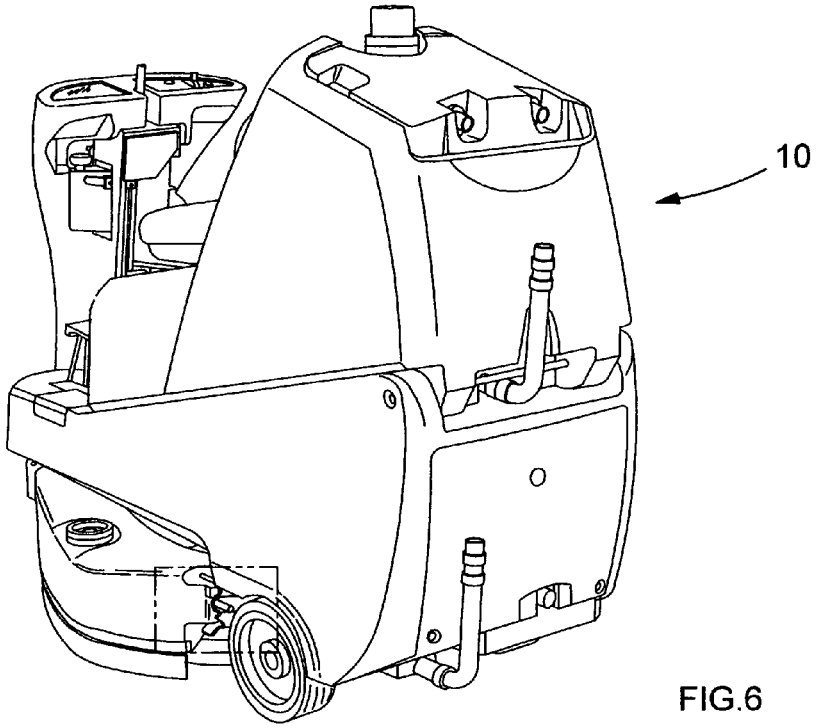
FIG. 6 is a perspective view of from the rear of a machine according to the invention.

The movement of the pods is governed by a mechanism shown in FIGS. 4 to 6.

Figure 4A:
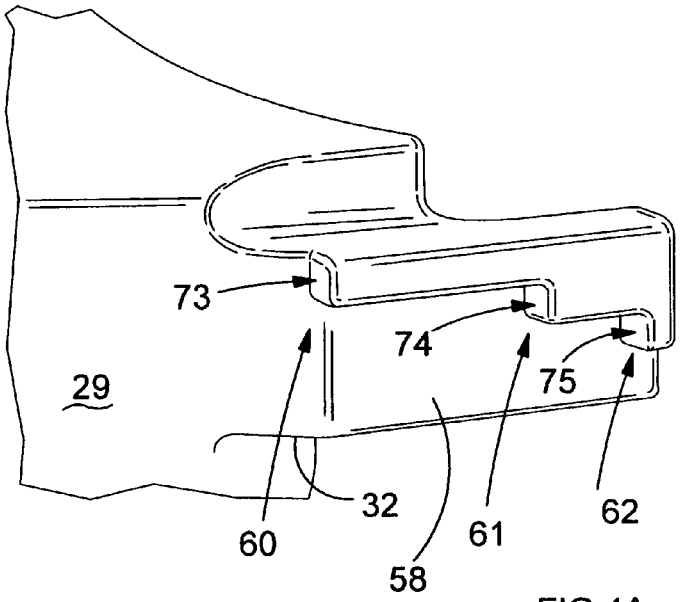
FIG. 4A is a perspective view of a side pod used in the invention.

In FIG. 4A one of the pods 29 is shown isolated from the rest of the machine. The pod is moulded from engineering plastics material. The front pivot is shown as A. The rear shoulder 32 of the pod has a rear wall surface 58. The surface 58 is formed with three raised step features 60, 61 and 62. These step features define three outward facing facets 73, 74 and 75.

Figure 6A:
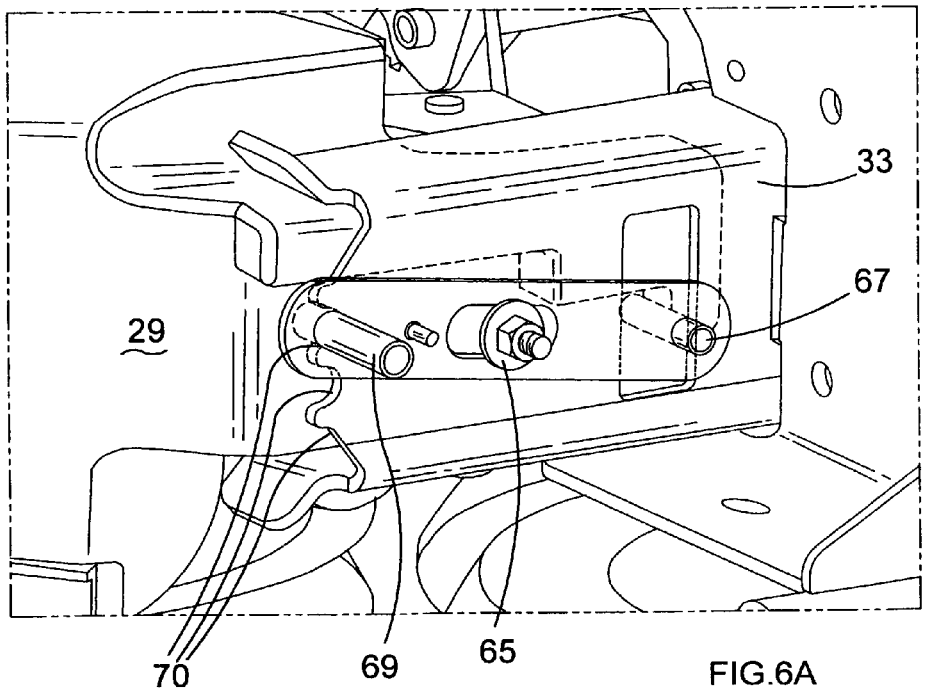
FIG. 6A is an enlarged view of the indicted portion of FIG. 6, showing the detent mechanism.

In FIG. 5 the side pod 29 is shown end-on in the C-section runner channel 33. A rocker arm 64 has a centre pivot 65 by which the lever is attached to the channel 33. One inner end region 66 of the rocker arm is provided with a stop bar 67 which is a cantilever rod. Another outer end region 68 of the rocker arm is provided with an adjustment lever 69. The orientation of the adjustment lever and stop bar are best seen in FIG. 6A.

The adjustment lever sits in one of three location slots 70 formed in the outer edge region of the runner channel 33. The lever permits manipulation of the rocker arm so that the stop bar can be pivoted up or down so that it abuts a desired facet 73, 74 or 75. As the facets are not only vertically, but also horizontally spaced apart, each of these abutments corresponds to a different lateral displacement of the pod, and thereby also the outer cleaning heads 34, 36. The facets provide constraint against outward splaying of the cleaning heads, but allow inner motion. This is important if an obstruction is encountered, as damage is thereby avoided.

Figure 7:
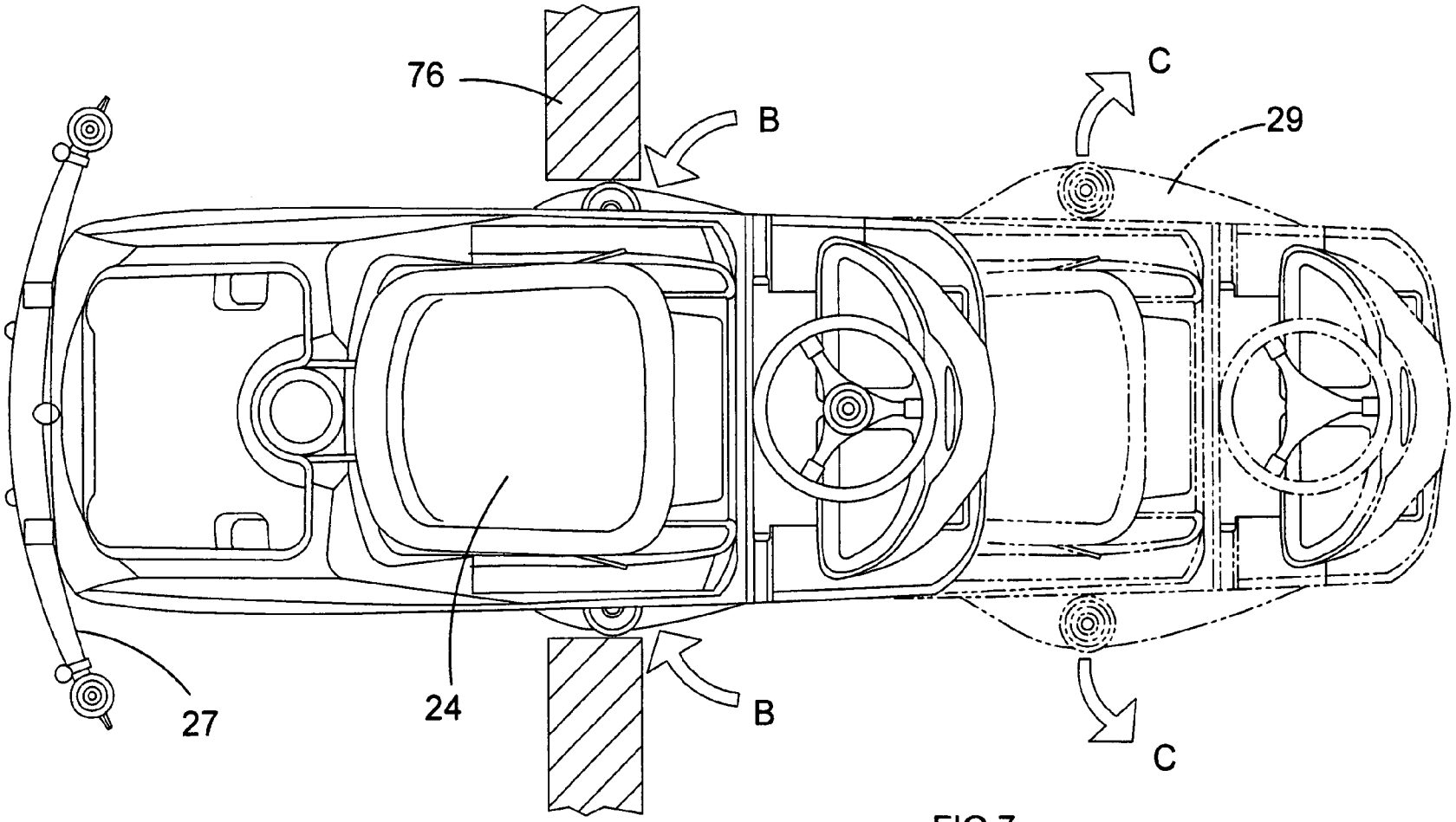
FIG. 7 is a view from above of the machine of the invention, when in use passing through a doorway.

The passage of a machine with splayed cleaning heads in a direction of travel T through a doorway 76 is shown in FIG. 7. While passing through the door way the pods are forced inwards (arrows B). Once through the doorway, the pods can move back outwards (arrows C).

The invention claimed is:

1. A floor cleaning machine comprising:

three spaced-apart floor facing rotationally drivable cleaning heads, each cleaning head having a working axis of rotation generally perpendicular to a floor surface, wherein the three cleaning heads comprise a central cleaning head and two lateral cleaning heads disposed on opposed sides of the central cleaning head;

wheel means for permitting translational movement of the machine along a cleaning path over the floor surface;

moveable mounting means for permitting selective adjustment of relative spatial locations of the cleaning heads so that a cleaning path swept by the heads is adjustable from a contracted arrangement in which the cleaning path swept has a contracted width to an expanded arrangement in which the cleaning path swept has an expanded width corresponding to the expanded adjusted relative spatial location of the cleaning heads, wherein the moveable mounting means comprises width selection means for providing at least three selectable discrete cleaning path widths, each respective cleaning path width corresponding to a discrete adjusted relative spatial location of the cleaning heads, wherein the width selection means comprises a plurality of housing portions, each housing portion shrouding a respective one of the lateral cleaning heads and configured to travel with the lateral cleaning head during outward movement thereof to expand the cleaning path, wherein the plurality of housing portions are restricted in their outward travel by a plurality of housing portion width settings, and wherein the plurality of housing portions limit and constrain outward travel of the lateral cleaning heads to an extent dictated by the housing portion width settings, wherein the width selection means limits outward lateral displacement of the lateral cleaning heads but does not prevent inward lateral movement of the lateral cleaning heads, and wherein the width selection means comprises an arrangement in which a lateral displacement of each lateral cleaning head is associated with the engagement of a detent feature with one of a plurality of spaced apart displacement constraint features.

2. The cleaning machine of claim 1, wherein the lateral cleaning heads are suspended from the moveable mounting means which permit the axis of rotation of each lateral head to be displaced laterally relative to the central cleaning head to widen the swept cleaning path.

3. The cleaning machine of claim 2, wherein an outside region of each lateral cleaning head is provided with a protective bumper which travels with the lateral cleaning head during lateral displacement thereof.

4. The cleaning machine of claim 3, wherein the bumper of each lateral cleaning head is attached to the machine at a forward pivot location and trails therefrom, the bumper thereby being configured to splay laterally about the pivot when the lateral cleaning head is displaced laterally.

5. The cleaning machine of claim 4, wherein each lateral cleaning head is mounted on the machine via a pivoted strut, and wherein the pivot of the strut is behind the forward pivot location.

6. The cleaning machine of claim 5, wherein each strut carries at an outer region thereof a roller which abuts an inner surface of the bumper of a respective lateral cleaning head.

7. The cleaning machine of claim 3, wherein the bumper comprises a housing which accommodates an outer region of the lateral cleaning head.

8. The cleaning machine of claim 3, wherein a trailing end region of the bumper of each lateral cleaning head is slidably retained in a C-section laterally extending channel.

9. The cleaning machine of claim 1, wherein the width selection means comprises a manually operable actuator which permits manual setting of the path by moving the detent feature to a selected displacement constraint feature.

10. The cleaning machine of claim 9, wherein the actuator comprises a rocking lever arm, which arm has a first end region which is provided with the detent feature.

11. The cleaning machine of claim 10, wherein a second end region of the lever arm is provided with a handle configured to be manually grasped to rock the lever arm about its pivot and thereby move the detent feature.

12. The cleaning machine of claim 11, wherein the detent feature on the lever arm is configured to be locked in position at each displacement constraint feature by engagement of the second end region of the lever arm with each of a plurality of arm constraint features.

13. The cleaning machine of claim 1, wherein the displacement constraint features comprise laterally and vertically spaced apart outward facing facets formed on a traveling member which displaces laterally with an associated lateral cleaning head.

14. The cleaning machine of claim 13, wherein each facet comprises a side face of one of a plurality of step features formed on a surface of the traveling member.

15. The cleaning machine of claim 13, wherein the detent feature comprises a rod which may be located parallel to and against each facet to provide constraint.

16. The cleaning machine of claim 13, wherein the traveling member comprises a respective housing portion of the plurality of housing portions.

17. The cleaning machine of claim 1, wherein the machine has a preferred direction of cleaning travel which defines a forward end of the machine and the central cleaning head is located aft on the machine relative to the lateral cleaning heads.

18. The cleaning machine of claim 17, wherein the central cleaning head and the lateral cleaning heads are arranged in a triangular configuration.

19. The cleaning machine of claim 18, wherein the lateral cleaning heads are carried by respective swinging arms which permit splaying travel of each lateral cleaning head with respect to the central cleaning head.

20. The cleaning machine of claim 19, wherein the central cleaning head is suspended from a mounting bracket, the mounting bracket providing pivoting anchorages for the two swinging arms.

21. The cleaning machine of claim 20, wherein the swinging arms extend generally forward for each pivoting anchorage.

22. The cleaning machine of claim 19, wherein biasing means are provided for biasing the swinging arms outwards, whilst clearance is provided which permits inward swinging of the arms in response to an arm encountering obstruction.

23. The cleaning machine of claim 20, wherein the mounting bracket comprises upper and lower mounting plate features, between which a pivot axle is held.

24. The cleaning machine of claim 1, wherein each cleaning head is provided with an associated electric drive motor.

25. The cleaning machine of claim 24, wherein the motors associated with the lateral cleaning heads are carried by and travel with a corresponding swinging arm.

26. The cleaning machine of claim 1, wherein each lateral cleaning head is carried by a swinging arm which may splay to expand the cleaning path, and each associated housing portion is pivotally anchored at one end thereof.

27. The cleaning machine of claim 26, wherein the swinging arm of each lateral cleaning head is provided with a wheel or roller which abuts an inner surface of the associated pivoted housing portion so that splaying of the swinging arms is limited in extent by the wheel or roller acting on the housing portion inner surface.

28. The cleaning machine of claim 1, wherein each housing portion is configured as a protective bumper located outside the rotation path of the lateral cleaning heads to protect the lateral heads against impact from external obstructions during use.

29. A floor cleaning machine comprising:

three spaced-apart floor facing rotationally drivable cleaning heads, each cleaning head having a working axis of rotation generally perpendicular to a floor surface, wherein the three cleaning heads comprise a central cleaning head and two lateral cleaning heads disposed on opposed sides of the central cleaning head;

wheel means for permitting translational movement of the machine along a cleaning path over the floor surface;

moveable mounting means for permitting selective adjustment of relative spatial locations of the cleaning heads so that a cleaning path swept by the heads is adjustable from a contracted arrangement in which the cleaning path swept has a contracted width to an expanded arrangement in which the cleaning path swept has an expanded width corresponding to the expanded adjusted relative spatial location of the cleaning heads, wherein the moveable mounting means comprises width selection means for providing at least three selectable discrete cleaning path widths, each respective cleaning path width corresponding to a discrete adjusted relative spatial location of the cleaning heads, wherein the width selection means comprises a plurality of housing portions, each housing portion shrouding a respective one of the lateral cleaning heads and configured to travel with the lateral cleaning head during outward movement thereof to expand the cleaning path, wherein the plurality of housing portions are restricted in their outward travel by a plurality of housing portion width settings, and wherein the plurality of housing portions limit and constrain outward travel of the lateral cleaning heads to an extent dictated by the housing portion width settings, wherein each lateral cleaning head is carried by a swinging arm which may splay to expand the cleaning path, and each associated housing portion is pivotally anchored at one end thereof, and wherein the swinging arm of each lateral cleaning head is provided with a wheel or roller which abuts an inner surface of the associated pivoted housing portion so that splaying of the swinging arms is limited in extent by the wheel or roller acting on the housing portion inner surface.

30. A floor cleaning machine comprising:

three spaced-apart floor facing rotationally drivable cleaning heads, each cleaning head having a working axis of rotation generally perpendicular to a floor surface, wherein the three cleaning heads comprise a central cleaning head and two lateral cleaning heads disposed on opposed sides of the central cleaning head;

wheel means for permitting translational movement of the machine along a cleaning path over the floor surface;

moveable mounting means for permitting selective adjustment of relative spatial locations of the cleaning heads so that a cleaning path swept by the heads is adjustable from a contracted arrangement in which the cleaning path swept has a contracted width to an expanded arrangement in which the cleaning path swept has an expanded width corresponding to the expanded adjusted relative spatial location of the cleaning heads, wherein the moveable mounting means comprises width selection means for providing at least three selectable discrete cleaning path widths, each respective cleaning path width corresponding to a discrete adjusted relative spatial location of the cleaning heads, wherein the width selection means comprises a plurality of housing portions, each housing portion shrouding a respective one of the lateral cleaning heads and configured to travel with the lateral cleaning head during outward movement thereof to expand the cleaning path, wherein the plurality of housing portions are restricted in their outward travel by a plurality of housing portion width settings, and wherein the plurality of housing portions limit and constrain outward travel of the lateral cleaning heads to an extent dictated by the housing portion width settings, wherein the width selection means limits outward lateral displacement of the lateral cleaning heads but does not prevent inward lateral movement of the lateral cleaning heads, wherein the lateral cleaning heads are suspended from the moveable mounting means which permit the axis of rotation of each lateral head to be displaced laterally relative to the central cleaning head to widen the swept cleaning path, wherein an outside region of each lateral cleaning head is provided with a protective bumper which travels with the lateral cleaning head during lateral displacement thereof, and wherein a trailing end region of the bumper of each lateral cleaning head is slidably retained in a C-section laterally extending channel.

* * * * *